US009711887B1

(12) United States Patent
Hu et al.

(10) Patent No.: US 9,711,887 B1
(45) Date of Patent: Jul. 18, 2017

(54) ELECTRICAL CONNECTOR

(71) Applicant: Cheng Uei Precision Industry Co., Ltd., New Taipei (TW)

(72) Inventors: Xing-Yu Hu, Dong-Guan (CN); Gao-Hua Du, Dong-Guan (CN)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 15/250,749

(22) Filed: Aug. 29, 2016

(51) Int. Cl.

| | |
|---|---|
| ***H01R 24/62*** | (2011.01) |
| ***H01R 24/60*** | (2011.01) |
| ***H01R 13/6585*** | (2011.01) |
| ***H01R 13/502*** | (2006.01) |
| ***H01R 13/434*** | (2006.01) |

(52) U.S. Cl.
CPC ..... *H01R 13/502* (2013.01); *H01R 13/434* (2013.01); *H01R 13/6585* (2013.01)

(58) Field of Classification Search
CPC H01R 13/502; H01R 13/434; H01R 13/6585; H01R 24/60; H01R 24/24; H01R 24/62; H01R 24/64
USPC ..... 439/607.05, 607.34, 607.35
See application file for complete search history.

(56) References Cited

U.S. PATENT DOCUMENTS

| | | | | |
|---|---|---|---|---|
| 7,824,220 | B2 * | 11/2010 | Chen | H01R 13/6477 439/607.35 |
| 8,011,956 | B1 * | 9/2011 | Yang | H01R 13/5202 439/589 |
| 8,926,367 | B2 * | 1/2015 | Hsu | H01R 13/658 439/607.35 |
| 2015/0171573 | A1 * | 6/2015 | Little | H01R 24/60 439/607.34 |
| 2015/0194768 | A1 * | 7/2015 | Little | H01R 13/6594 439/607.37 |
| 2015/0372424 | A1 * | 12/2015 | Little | H01R 13/642 439/217 |

* cited by examiner

*Primary Examiner* — Harshad Patel
(74) *Attorney, Agent, or Firm* — Cheng-Ju Chiang

(57) ABSTRACT

An electrical connector includes an insulating housing, a terminal module, two adhesive films and a shielding shell. The insulating housing defines two rows of terminal grooves. The terminal module assembled to the insulating housing includes a plurality of conductive terminals. Front ends of the conductive terminals project into the terminal grooves. Each of the two adhesive films includes an insulation layer and an adhesive layer. The adhesive layer is disposed to a rear end of an inner surface of the insulation layer. The adhesive layer of one of the two adhesive films is adhered to a top wall of the insulating housing, and the adhesive layer of the other adhesive film is adhered to a bottom wall of the insulating housing. The insulating housing together with the terminal module and the adhesive films are received in a receiving space of the shielding shell.

13 Claims, 5 Drawing Sheets

ELECTRICAL CONNECTOR

BACKGROUND OF THE INVENTION

1. Field of the Invention

The present invention generally relates to a connector, and more particularly to an electrical connector having an adhesive layer disposed between a shielding shell and an insulating housing for preventing a short circuit being caused between conductive terminals and the shielding shell.

2. The Related Art

A conventional electrical connector includes an insulating housing, a terminal module, an adhesive layer and a shielding shell. The insulating housing includes a top wall, a bottom wall, a rear wall and two lateral walls. An insertion space is formed among the top wall, the bottom wall, the rear wall and the two lateral walls. The top wall and the bottom wall of the insulating housing define a plurality of terminal grooves. The rear wall of the insulating housing opens an inserting groove. The terminal module includes a plurality of conductive terminals and a dielectric body. The dielectric body is integrally molded with the conductive terminals. Front ends of the conductive terminals project beyond a front surface of the dielectric body. The dielectric body is inserted to the inserting groove. The front ends of the conductive terminals project into the terminal grooves. The shielding shell surrounds the insulating housing. The adhesive layer is disposed between the shielding shell and the insulating housing for preventing a short circuit being caused between the conductive terminals and the shielding shell.

However, in a process of the front ends of the conductive terminals bouncing outward, when the front ends of the conductive terminals abut against the adhesive layer, the front ends of the conductive terminals are easily adhered to the adhesive layer to have no way of being rebounded that makes the conductive terminals have a poorer electrical connection.

Thus, whether the above-mentioned problems are solved by virtue of designing an innovative electrical connector has become an important issue to be solved by persons skilled in the art, so that the innovative electrical connector with a rational design and effectively solving the above-mentioned problems need be provided.

SUMMARY OF THE INVENTION

An object of the present invention is to provide an electrical connector. The electrical connector includes an insulating housing, a terminal module, two adhesive films and a shielding shell. The insulating housing has a top wall, a bottom wall facing the top wall, two lateral walls connected between the top wall and the bottom wall, and a rear wall connected with rear ends of the top wall, the bottom wall and the two lateral walls. An insertion space is surrounded among the top wall, the bottom wall, the rear wall and the two lateral walls. The insulating housing defines two rows of parallel terminal grooves along an up-down direction. The two rows of the terminal grooves include an upper row of the terminal grooves penetrating through the top wall along the up-down direction and longitudinally penetrating through an upper portion of the rear wall, and a lower row of the terminal grooves penetrating through the bottom wall along the up-down direction and longitudinally penetrating through a lower portion of the rear wall. The terminal grooves are communicated with the insertion space. The terminal module is assembled to the insulating housing. The terminal module includes a plurality of conductive terminals. The conductive terminals are arranged in two rows. Front ends of the conductive terminals project into the terminal grooves. Each of the two adhesive films includes an insulation layer and an adhesive layer. A size of the adhesive layer is smaller than a size of the insulation layer. The adhesive layer is disposed to a rear end of an inner surface of the insulation layer. The adhesive layer of one of the two adhesive films is adhered to the top wall of the insulating housing and located over the upper row of the terminal grooves, and the adhesive layer of the other adhesive film is adhered to the bottom wall of the insulating housing and located under the lower row of the terminal grooves. The shielding shell has a top plate, a bottom plate facing to the top plate, and two lateral plates connected between the top plate and the bottom plate. A receiving space is formed among the top plate, the bottom plate and the two lateral plates. The insulating housing together with the terminal module and the adhesive films is received in the receiving space. When the front ends of the conductive terminals bounce outward, the front ends of the conductive terminals directly abut against the insulation layers of the two adhesive films.

As described above, the adhesive films are disposed between the conductive terminals and the shielding shell, so that a short circuit between the conductive terminals and the shielding shell is effectively avoided when the conductive terminals bounce outward. Furthermore, when the conductive terminals bounce outward, the conductive terminals directly abut against the insulation layers of the two adhesive films and never abut against the adhesive layers of the two adhesive films on account of the size of the adhesive layer being smaller than the size of the insulation layer, so that a situation of the conductive terminals abutting against and being adhered to the adhesive layers of the two adhesive films is prevented being occurred. As a result, the conductive terminals are capable of being rebounded freely to make the conductive terminals have a better electrical connection.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
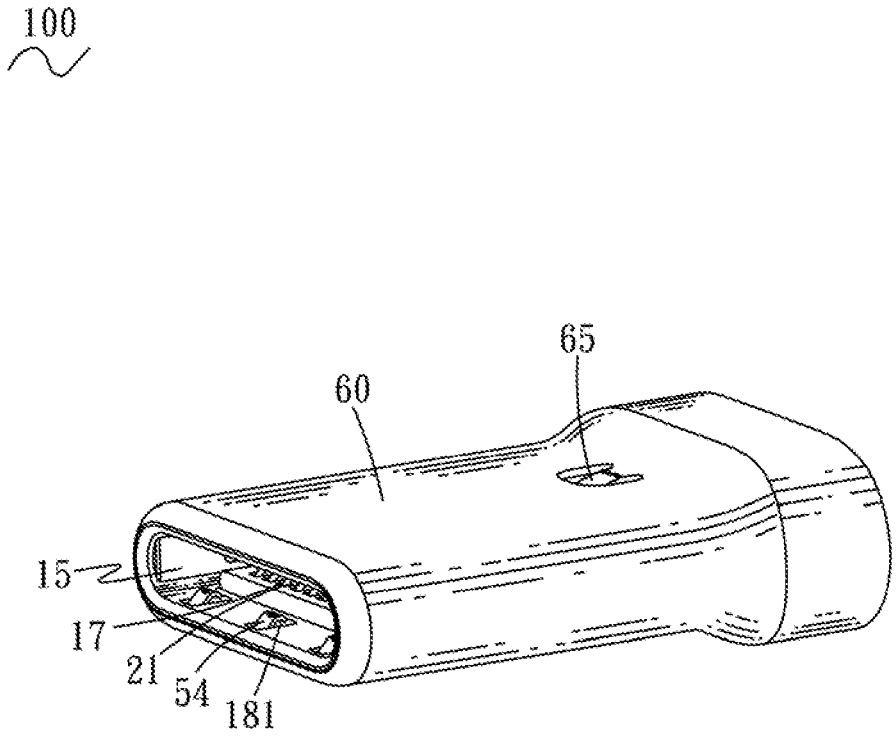
FIG. 1 is a perspective view of an electrical connector in accordance with an embodiment of the present invention.
Figure 2:
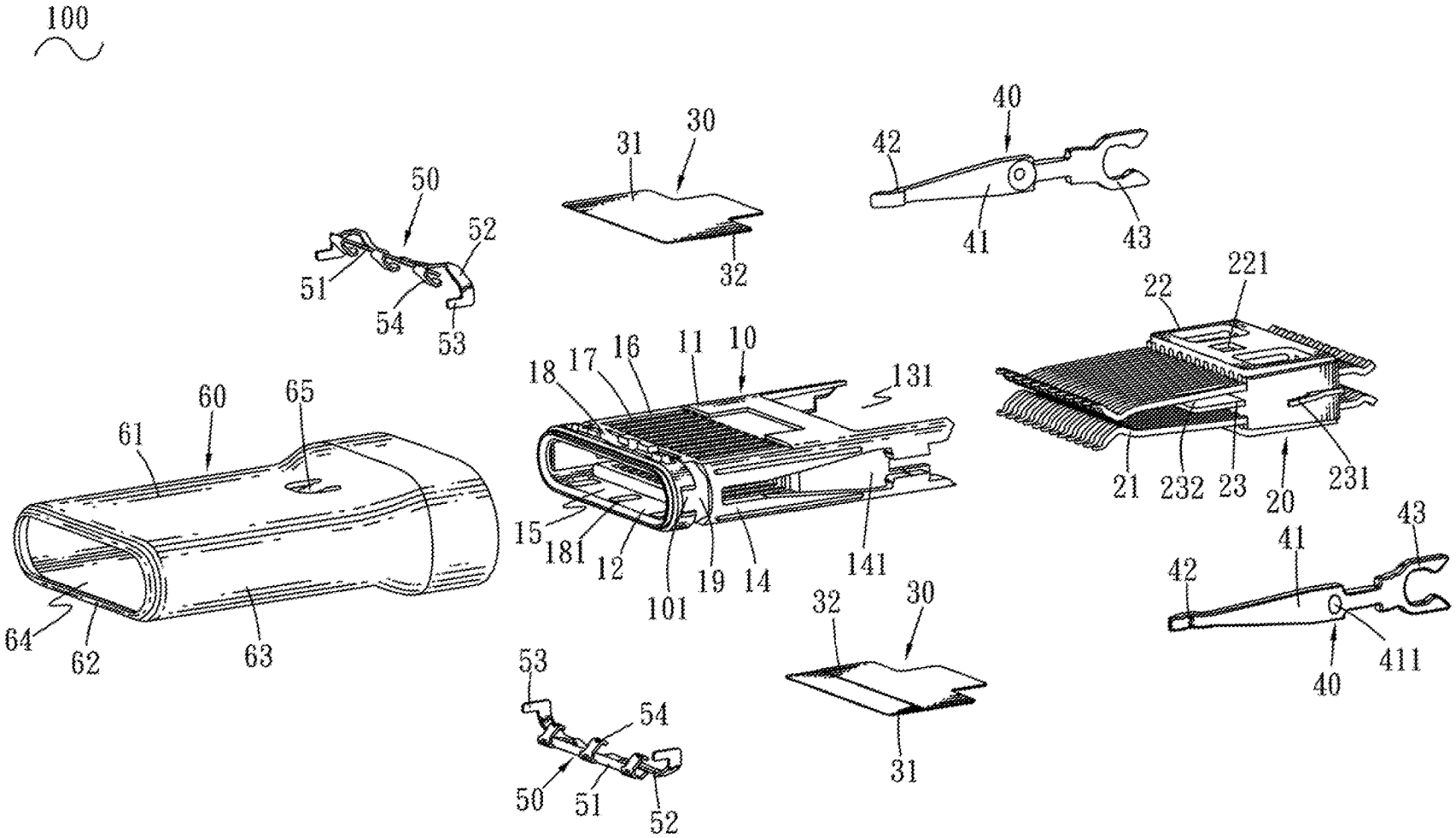
FIG. 2 is an exploded view of the electrical connector of FIG. 1.

With reference to FIG. 1 and FIG. 2, an electrical connector 100 in accordance with an embodiment of the present invention is shown. The electrical connector 100 includes an insulating housing 10, a terminal module 20, two adhesive films 30, two clamping elements 40, two shielding elements 50 and a shielding shell 60.

Figure 4:
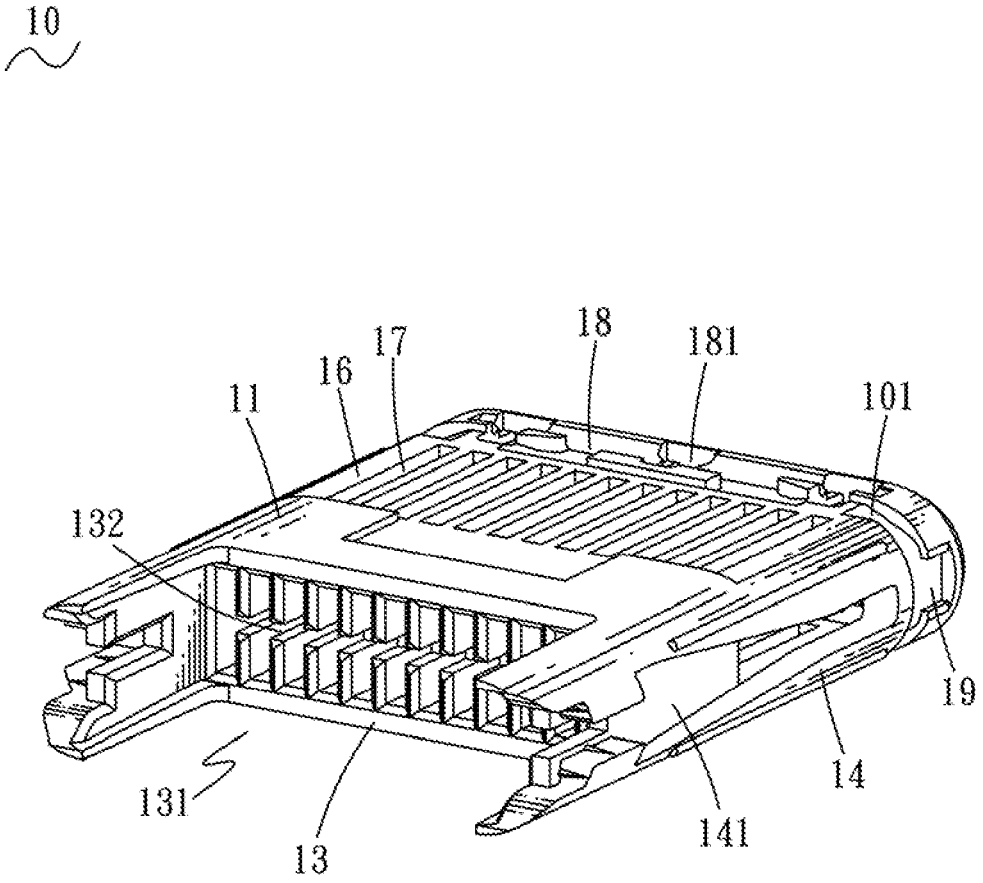
FIG. 4 is a perspective view of an insulating housing of the electrical connector of FIG. 1.

Referring to FIG. 2 and FIG. 4, the insulating housing 10 has a top wall 11, a bottom wall 12 facing the top wall 11, two lateral walls 14 connected between the top wall 11 and the bottom wall 12, and a rear wall 13 connected with rear ends of the top wall 11, the bottom wall 12 and the two lateral walls 14. A front surface of the insulating housing 10 is recessed inward to form an insertion space 15 which is surrounded among the top wall 11, the bottom wall 12, the rear wall 13 and the two lateral walls 14. The insulating housing 10 defines two rows of parallel terminal grooves 17 along an up-down direction. The terminal grooves 17 penetrate through the rear wall 13 of the insulating housing 10.

The two rows of the terminal grooves 17 include an upper row of the terminal grooves 17, and a lower row of the terminal grooves 17 located under the upper row of the terminal grooves 17. The upper row of the terminal grooves 17 are arranged transversely. The upper row of the terminal grooves 17 penetrate through the top wall 11 of the insulating housing 10 along the up-down direction and longitudinally penetrate through an upper portion of the rear wall 13 of the insulating housing 10. The lower row of the terminal grooves 17 are arranged transversely. The lower row of the terminal grooves 17 penetrate through the bottom wall 12 of the insulating housing 10 along the up-down direction and longitudinally penetrate through a lower portion of the rear wall 13 of the insulating housing 10. Preferably, the upper row of the terminal grooves 17 is symmetrical to the lower row of the terminal grooves 17. The terminal grooves 17 are communicated with the insertion space 15.

A top surface of the top wall 11 and a bottom surface of the bottom wall 12 of the insulating housing 10 are recessed inward to form two fastening cavities 16, respectively. The terminal grooves 17 are communicated with the fastening cavities 16. The top surface of the top wall 11 and the bottom surface of the bottom wall 12 of the insulating housing 10 define two fixing grooves 18, respectively. The two fixing grooves 18 are located in front of the two fastening cavities 16. Two opposite sides of a front end of the insulating housing 10 are recessed inward to form two locking grooves 19 adjacent to two opposite sides of the two fixing grooves 18. The two fixing grooves 18 and the two locking grooves 19 together define a locating space 101. The top wall 11 and the bottom wall 12 of the insulating housing 10 open a plurality of perforations 181 in the fixing grooves 18.

The perforations 181 are communicated with the insertion space 15. A middle of the rear wall 13 of the insulating housing 10 is recessed frontward to form an inserting groove 131. A middle of a rear surface of a front wall of the inserting groove 131 is recessed inward to form a fastening slot 132. The two lateral walls 14 of the insulating housing 10 open two clamping grooves 141 longitudinally penetrating through rears thereof and transversely penetrating through middles thereof, respectively. Front ends of the two clamping grooves 141 are communicated with the insertion space 15. Rear ends of the two clamping grooves 141 are communicated with the inserting groove 131.

Referring to FIG. 2, the terminal module 20 includes a plurality of conductive terminals 21, a dielectric body 22 and a shielding plate 23. A top surface and a bottom surface of the dielectric body 22 are recessed inward to form two restricting grooves 221. The shielding plate 23 has a base plate 232, and two abutting portions 231 protruded outward from two opposite sides of the base plate 232. The dielectric body 22 is integrally molded to middles of the conductive terminals 21 and the shielding plate 23. Front ends and rear ends of the conductive terminals 21 are exposed out of the dielectric body 22. The conductive terminals 21 are arranged in two rows. Each row of the conductive terminals 21 are arranged transversely. The shielding plate 23 is located between the two rows of the conductive terminals 21. The two abutting portions 231 project out of two opposite sides of the dielectric body 22.

Referring to FIG. 2 to FIG. 5, the terminal module 20 is assembled frontward to the insulating housing 10. The dielectric body 22 is inserted to the inserting groove 131. The front ends of the conductive terminals 21 project into the terminal grooves 17. A front end of the shielding plate 23 is fastened in the fastening slot 132. The two abutting portions 231 of the shielding plate 23 project into the two clamping grooves 141 of the insulating housing 10, respectively.

One of the two adhesive films 30 is adhered to the top wall 11 of the insulating housing 10 and located over the upper row of the terminal grooves 17, and the other adhesive film 30 is adhered to the bottom wall 12 of the insulating housing 10 and located under the lower row of the terminal grooves 17. The two adhesive films 30 are adhered to inner walls of the two fastening cavities 16 of the insulating housing 10, respectively. Each of the two adhesive films 30 includes an insulation layer 31 and an adhesive layer 32. A size of the adhesive layer 32 is smaller than a size of the insulation layer 31. The adhesive layer 32 is disposed to an inner surface of the insulation layer 31. The adhesive layer 32 is disposed to a rear end of the inner surface of the insulation layer 31.

The adhesive layer 32 of one of the two adhesive films 30 is adhered to the top wall 11 of the insulating housing 10 and located over the upper row of the terminal grooves 17, and the adhesive layer 32 of the other adhesive film 30 is adhered to the bottom wall 12 of the insulating housing 10 and located under the lower row of the terminal grooves 17. The adhesive layers 32 of the two adhesive films 30 are adhered to the inner walls of the two fastening cavities 16. When the front ends of the conductive terminals 21 bounce outward, the front ends of the conductive terminals 21 directly abut against the insulation layers 31 of the two adhesive films 30 and never abut against the adhesive layers 32 of the two adhesive films 30 on account of the size of the adhesive layer 32 being smaller than the size of the insulation layer 31, so that a situation of the front ends of the conductive terminals 21 abutting against and being adhered to the adhesive layers 32 of the two adhesive films 30 is prevented being occurred. In this embodiment, the front ends of the conductive terminals 21 directly abut against front ends of the inner surfaces of the insulation layers 31 of the two adhesive films 30 when the front ends of the conductive terminals 21 bounce outward.

Figure 3:
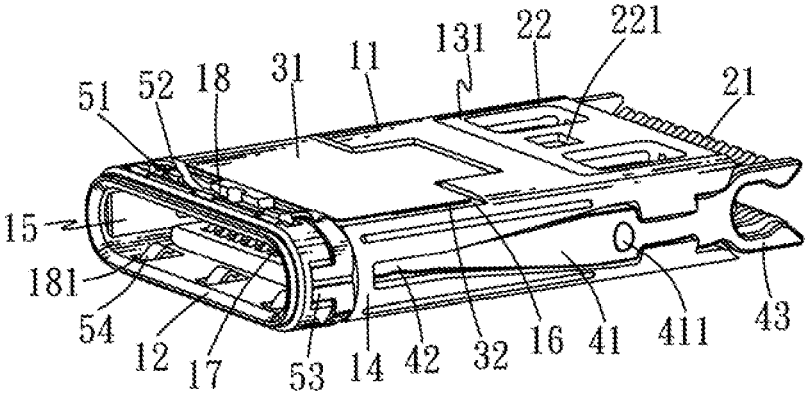
FIG. 3 is a perspective view of the electrical connector of FIG. 1, wherein a shielding shell is removed.

Referring to FIG. 2, FIG. 3 and FIG. 4, the two clamping elements 40 are correspondingly assembled to the two clamping grooves 141, respectively. Each of the two clamping elements 40 has a fastening portion 41 extending longitudinally, a clamping portion 42 arched inward from a front end of the fastening portion 41, and a buckling portion 43 extended rearward from a rear end of the fastening portion 41. A rear end of the buckling portion 43 is of a lying U shape with the mouth thereof facing rearward. A middle of the fastening portion 41 of each of the two clamping elements 40 protrudes outward to form a convex portion 411. Specifically, the fastening portions 41 of the two clamping elements 40 are fastened in the two clamping grooves 141, respectively. The clamping portions 42 of the two clamping elements 40 project into the insertion space 15 of the insulating housing 10. The buckling portions 43 of the two clamping elements 40 face to the conductive terminals 21 of the terminal module 20. The two abutting portions 231 of the shielding plate 23 abut against the two clamping elements 40, respectively.

The two shielding elements 50 are correspondingly located in an upper portion and a lower portion of the locating space 101, respectively. Each of the two shielding elements 50 has a fixing piece 51 extending transversely. Two sides of a middle of a rear end of the fixing piece 51 slantwise extend sideward and oppositely, and then are arched outward to form two elastic arms 52. Tail ends of the two elastic arms 52 are bent inward and then extend frontward to form two locking pieces 53. Several portions of a front edge of the fixing piece 51 are obliquely curved rearward and inward and then arched inward to form a plurality of contact portions 54. Specifically, the fixing pieces 51 of the two shielding elements 50 are fixed in fronts of the two fixing grooves 18, respectively. The elastic arms 52 of the two shielding elements 50 are received in rears of the two fixing grooves 18. The elastic arms 52 project beyond the top wall 11 and the bottom wall 12 of the insulating housing 10, respectively. The locking pieces 53 of the two shielding elements 50 are locked in the two locking grooves 19. The contact portions 54 pass through the perforations 181 to project into the insertion space 15.

Figure 5:
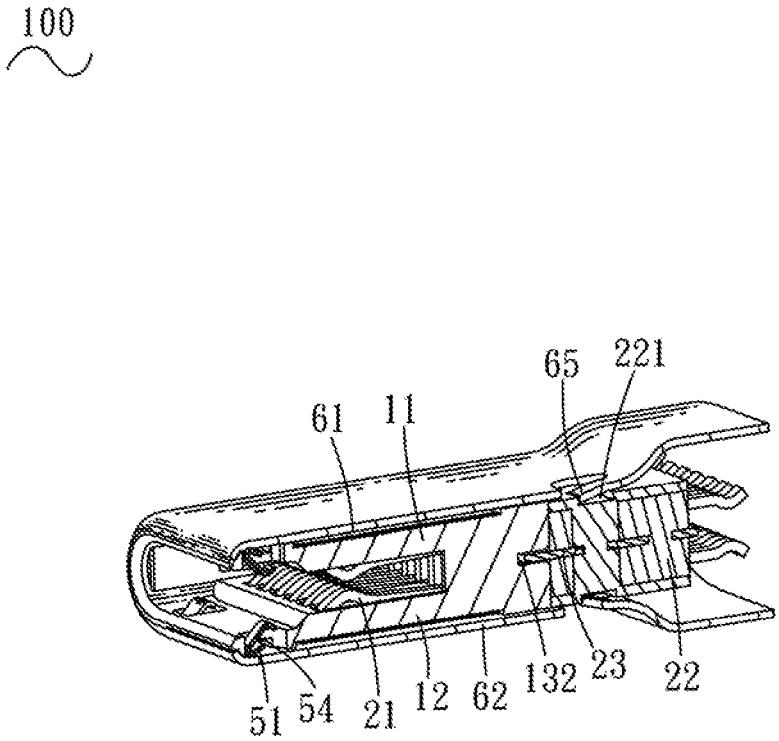
FIG. 5 is a sectional view of the electrical connector of FIG. 1.

Referring to FIG. 1, FIG. 2 and FIG. 5, the shielding shell 60 surrounds the insulating housing 10 together with the terminal module 20, the adhesive films 30, the clamping elements 40 and the shielding elements 50. The shielding shell 60 has a top plate 61, a bottom plate 62 facing to the top plate 61, and two lateral plates 63 connected between the top plate 61 and the bottom plate 62. A receiving space 64 is formed among the top plate 61, the bottom plate 62 and the two lateral plates 63. The insulating housing 10 together with the terminal module 20, the adhesive films 30, the clamping elements 40 and the shielding elements 50 is received in the receiving space 64. The top plate 61 and the bottom plate 62 are punched inward to form two restricting pieces 65. The two restricting pieces 65 are restricted in the two restricting grooves 221, respectively.

The adhesive films 30 are disposed between the conductive terminals 21 and the shielding shell 60. The insulation layer 31 of one of the adhesive films 30 is disposed between the top plate 61 and the upper row of the conductive terminals 21, and the insulation layer 31 of the other adhesive film 30 is disposed between the bottom plate 62 and the lower row of the conductive terminals 21, so that a short circuit between the conductive terminals 21 and the shielding shell 60 is effectively avoided when the conductive terminals 21 bounce outward. The elastic arms 52 of the two shielding elements 50 abut against the top plate 61 and the bottom plate 62, respectively. The convex portions 411 of the clamping elements 40 abut against the two lateral plates 63 of the shielding shell 60, respectively.

As described above, the adhesive films 30 are disposed between the conductive terminals 21 and the shielding shell 60, so that the short circuit between the conductive terminals 21 and the shielding shell 60 is effectively avoided when the conductive terminals 21 bounce outward. Furthermore, when the front ends of the conductive terminals 21 bounce outward, the front ends of the conductive terminals 21 directly abut against the insulation layers 31 of the two adhesive films 30 and never abut against the adhesive layers 32 of the two adhesive films 30 on account of the size of the adhesive layer 32 being smaller than the size of the insulation layer 31, so that the situation of the front ends of the conductive terminals 21 abutting against and being adhered to the adhesive layers 32 of the two adhesive films 30 is prevented being occurred. As a result, the conductive terminals 21 are capable of being rebounded freely to make the conductive terminals 21 have a better electrical connection.

What is claimed is:

1. An electrical connector, comprising:

an insulating housing having a top wall, a bottom wall facing the top wall, two lateral walls connected between the top wall and the bottom wall, and a rear wall connected with rear ends of the top wall, the bottom wall and the two lateral walls, an insertion space surrounded among the top wall, the bottom wall, the rear wall and the two lateral walls, the insulating housing defining two rows of parallel terminal grooves along an up-down direction, the two rows of the terminal grooves including an upper row of the terminal grooves penetrating through the top wall along the up-down direction and longitudinally penetrating through an upper portion of the rear wall, and a lower row of the terminal grooves penetrating through the bottom wall along the up-down direction and longitudinally penetrating through a lower portion of the rear wall, the terminal grooves being communicated with the insertion space;

a terminal module assembled to the insulating housing, the terminal module including a plurality of conductive terminals, the conductive terminals being arranged in two rows, front ends of the conductive terminals projecting into the terminal grooves;

two adhesive films, each of the two adhesive films including an insulation layer and an adhesive layer, a size of the adhesive layer being smaller than a size of the insulation layer, the adhesive layer being disposed to a rear end of an inner surface of the insulation layer, the adhesive layer of one of the two adhesive films being adhered to the top wall of the insulating housing and located over the upper row of the terminal grooves, and the adhesive layer of the other adhesive film being adhered to the bottom wall of the insulating housing and located under the lower row of the terminal grooves; and a shielding shell having a top plate, a bottom plate facing to the top plate, and two lateral plates connected between the top plate and the bottom plate, a receiving space being formed among the top plate, the bottom plate and the two lateral plates, the insulating housing together with the terminal module and the adhesive films being received in the receiving space;

wherein when the front ends of conductive terminals bounce outward, the front ends of conductive terminals directly abut against the insulation layers of the two adhesive films.

2. The electrical connector as claimed in claim 1, wherein a top surface of the top wall and a bottom surface of the bottom wall of the insulating housing are recessed inward to form two fastening cavities, respectively, the terminal grooves are communicated with the fastening cavities, the adhesive layers of the two adhesive films are adhered to inner walls of the two fastening cavities.

3. The electrical connector as claimed in claim 1, wherein a middle of the rear wall of the insulating housing is recessed frontward to form an inserting groove, the terminal module further includes a dielectric body and a shielding plate, the dielectric body is integrally molded to middles of the conductive terminals and the shielding plate, the dielectric body is inserted to the inserting groove.

4. The electrical connector as claimed in claim 3, wherein the front ends of the conductive terminals are exposed out of the dielectric body, the front ends of the conductive terminals directly abut against front ends of the inner surfaces of the insulation layers of the two adhesive films when the front ends of the conductive terminals bounce outward.

5. The electrical connector as claimed in claim 3, wherein the shielding plate is located between the two rows of the conductive terminals, a middle of a rear surface of a front wall of the inserting groove is recessed inward to form a fastening slot, a front end of the shielding plate is fastened in the fastening slot.

6. The electrical connector as claimed in claim 3, wherein the two lateral walls of the insulating housing open two clamping grooves longitudinally penetrating through rears thereof and transversely penetrating through middles thereof, respectively, front ends of the two clamping grooves are communicated with the insertion space, rear ends of the two clamping grooves are communicated with the inserting groove, the shielding plate has a base plate, and two abutting portions protruded outward from two opposite sides of the base plate, the two abutting portions project out of two opposite sides of the dielectric body, the two abutting portions project into the two clamping grooves, respectively.

7. The electrical connector as claimed in claim 6, further comprising two clamping elements, each of the two clamping elements having a fastening portion extending longitudinally, a clamping portion arched inward from a front end of the fastening portion, and a buckling portion extended rearward from a rear end of the fastening portion, the fastening portions of the two clamping elements being fastened in the two clamping grooves, respectively, the clamping portions of the two clamping elements projecting into the insertion space, the buckling portions of the two clamping elements facing to the conductive terminals, the two abutting portions of the shielding plate abutting against the two clamping elements, respectively.

8. The electrical connector as claimed in claim 7, wherein a rear end of the buckling portion is of a lying U shape with the mouth thereof facing rearward.

9. The electrical connector as claimed in claim 7, wherein a middle of the fastening portion of each of the two clamping elements protrudes outward to form a convex portion, the convex portions of the clamping elements abut against the two lateral plates of the shielding shell, respectively.

10. The electrical connector as claimed in claim 3, wherein a top surface and a bottom surface of the dielectric body are recessed inward to form two restricting grooves, the top plate and the bottom plate of the shielding shell are punched inward to form two restricting pieces, the two restricting pieces are restricted in the two restricting grooves, respectively.

11. The electrical connector as claimed in claim 1, further comprising two shielding elements, a top surface of the top wall and a bottom surface of the bottom wall of the insulating housing defining two fixing grooves, respectively, two opposite sides of a front end of the insulating housing being recessed inward to form two locking grooves adjacent to two opposite sides of the two fixing grooves, the two fixing grooves and the two locking grooves together defining a locating space, the two shielding elements being correspondingly located in an upper portion and a lower portion of the locating space, respectively.

12. The electrical connector as claimed in claim 11, wherein each of the two shielding elements has a fixing piece extending transversely, two sides of a middle of a rear end of the fixing piece slantwise extend sideward and oppositely, and then are arched outward to form two elastic arms, tail ends of the two elastic arms are bent inward and then extend frontward to form two locking pieces, the fixing pieces of the two shielding elements are fixed in fronts of the two fixing grooves, respectively, the elastic arms of the two shielding elements are received in rears of the two fixing grooves and project beyond the top wall and the bottom wall of the insulating housing, respectively, the locking pieces of the two shielding elements are locked in the two locking grooves.

13. The electrical connector as claimed in claim 11, wherein several portions of a front edge of the fixing piece are obliquely curved rearward and inward and then arched inward to form a plurality of contact portions, the top wall and the bottom wall of the insulating housing open a plurality of perforations in the fixing grooves, the contact portions pass through the perforations to project into the insertion space.

* * * * *